US007455171B2

(12) United States Patent
Buechel

(10) Patent No.: US 7,455,171 B2
(45) Date of Patent: Nov. 25, 2008

(54) METHOD AND APPARATUS FOR PROCESSING PRINTED ARTICLES

(75) Inventor: Karl Buechel, Hinwil (CH)

(73) Assignee: Ferag AG, Hinwil (CH)

( * ) Notice: Subject to any disclaimer, the term of this patent is extended or adjusted under 35 U.S.C. 154(b) by 218 days.

(21) Appl. No.: 11/287,997

(22) Filed: Nov. 28, 2005

(65) Prior Publication Data

US 2006/0113165 A1 Jun. 1, 2006

(30) Foreign Application Priority Data

Nov. 26, 2004 (CH) ..... 1956/04

(51) Int. Cl.
*B65H 7/14* (2006.01)
*B65H 7/20* (2006.01)

(52) U.S. Cl. ..... 198/502.2; 198/644

(58) Field of Classification Search ..... 198/502.2, 198/644; 271/268, 85
See application file for complete search history.

(56) References Cited

U.S. PATENT DOCUMENTS 3,507,492 A * 4/1970 Spencer ..... 271/188
4,037,525 A * 7/1977 Sjogren et al. ..... 414/788.3
4,604,851 A * 8/1986 Reist ..... 53/430
5,154,279 A 10/1992 Hansch
5,395,151 A 3/1995 Eberle
5,477,240 A 12/1995 Huebner et al.
5,772,391 A * 6/1998 Sjogren et al. ..... 414/790.9
6,119,358 A 9/2000 Haensch
6,543,989 B1 * 4/2003 Derenthal et al. ..... 414/790
6,876,716 B2 * 4/2005 Sjogren et al. ..... 377/8
7,002,135 B2 * 2/2006 Sjogren ..... 250/221
2005/0040322 A1 2/2005 Sjogren

FOREIGN PATENT DOCUMENTS

DE 34 19 436 A1 12/1984
EP 0 340 434 A2 11/1989
EP 0 897 887 A1 2/1999
EP 1 148 007 A1 10/2001

* cited by examiner

*Primary Examiner*—Mark A Deuble
(74) *Attorney, Agent, or Firm*—Alston & Bird LLP

(57) ABSTRACT

Printed articles 18 are fed to a processing device 32 by means of a conveying device 10. A measuring device 22 measures the thickness of the printed articles 18 and transmits a corresponding measured signal 28 to a control device 30 of a processing device 32. The latter can be formed, for example, by a packaging machine 34, and the control device uses the measured signal 28 as a basis to actuate processing elements 71 of the packaging machine, such as an input belt conveyor 36, a pressure roller pressing element 48, a stabilization element 54, or a stack forming device 58, via drive and actuating motors 40, 50, 66.

9 Claims, 3 Drawing Sheets

METHOD AND APPARATUS FOR PROCESSING PRINTED ARTICLES

BACKGROUND OF THE INVENTION

The present invention relates to a method and an apparatus for processing printed articles, such as generally flat flexible printed articles, and which includes measuring the thickness of the articles as they are transported in succession along a path of travel.

Methods and apparatus of this type are known from EP-A-0 897 887 and EP-A-0 479 717, and corresponding U.S. Pat. Nos. 6,119,358 and 5,154,279, respectively. By means of a thickness measuring device, the thickness of each printed article transported past it by means of a conveying device is measured. A measured signal produced in the process is supplied to a control device which, in order to control the thickness of the printed article, compares the measured signal with a desired range. If the measured thickness of a printed article lies outside the tolerance range, this article is classified as incomplete or as defective and separated out.

It is an object of the present invention to develop the known method and the known apparatus for extended use.

SUMMARY OF THE INVENTION

The above and other objects and advantages of the present invention are achieved by the provision of a method and apparatus wherein the thickness measurement of printed articles is not used to control the printed articles as in the above cited prior patent documents, but to control a processing device connected downstream of a conveying device transporting the printed articles. As a result, manual actions, such as setting and adjustment work, on the processing device are avoided, for example when changing the processing of printed articles of a specific thickness to printed articles of another thickness or when processing printed articles of different thickness.

BRIEF DESCRIPTION OF THE DRAWINGS

The present invention will be explained in more detail by using an exemplary embodiment illustrated in the drawings, in which, purely schematically.

DETAILED DESCRIPTION OF THE PREFERRED EMBODIMENT

Figure 1:
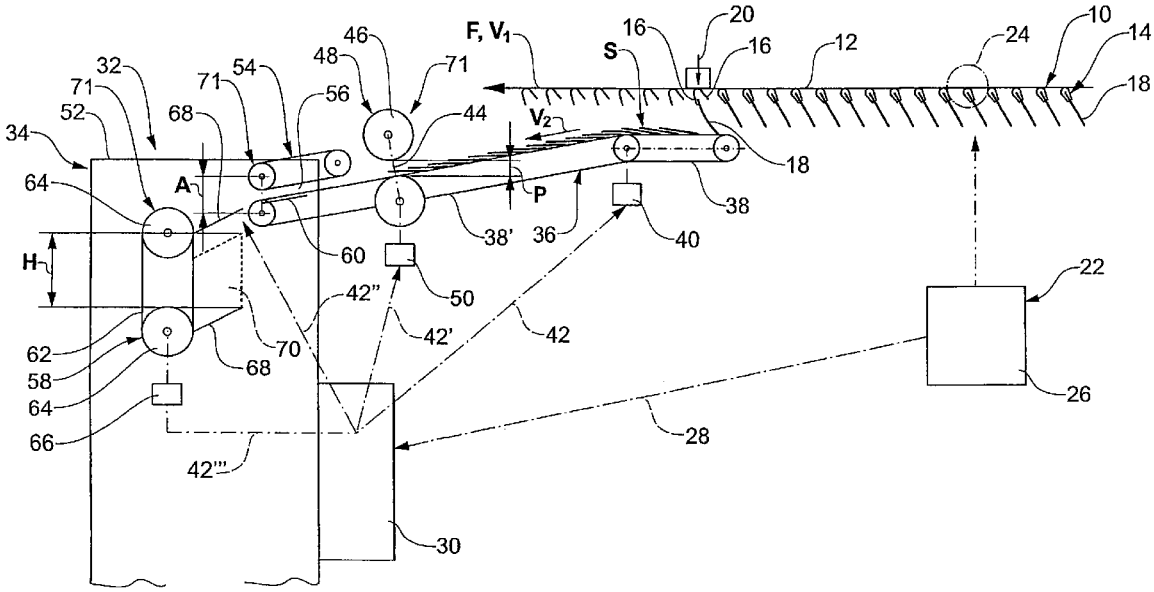
FIG. 1 shows in elevation a conveying device and a packaging machine loaded with printed articles, and wherein settings are carried out automatically as a function of a thickness measurement of the printed articles in accordance with the present invention.

The apparatus shown in FIG. 1 comprises a conveying device 10 constructed as a clamp transporter. Clamp transporters of this type are generally known. They have a conveying element 12 which is arranged in a guide channel, which is driven in circulation in the conveying direction F at a conveying speed $V_1$ and on which transport clamps 14 are arranged one after another at regular intervals. In the section of the conveying device 10 shown in FIG. 1, which runs rectilinearly and horizontally, the transport clamps 14 are located underneath the conveying element 12. The transport clamps 14 are intended to hold and to transport a printed article 18 with their two clamping tongues 16 forming a clamping jaw.

A triggering device is shown at 20 which is assigned to the conveying device 10 and which is intended, in the actuated state, to open the clamping jaw of the transport clamps 14 moved past it, so that the relevant printed articles 18, transported in a suspended manner, are released at the triggering device 20. In the non-actuated state, the triggering device 20 does not act on the transport clamps 14 moved past it, so that no printed articles 18 are then released at the triggering device 20 and these are conveyed onwards by means of the conveying device 10.

Furthermore, the conveying device 10 is assigned a measuring device 22 for measuring the thickness D of the printed articles 18. Upstream of the triggering device 20, a thickness measuring arrangement 24 is positioned, which is described in more detail below in connection with FIGS. 2 and 3. The arrangement 24 outputs sensor signals to a signal conditioning unit 26 upon the passage of each transport clamp 14. The sensor signals generated on the basis of the thickness of the printed articles 18 guided past the thickness measuring arrangement 24 are conditioned in the signal conditioning unit 26 to form a measured signal 28 which, as the dash-dotted line indicates, is supplied to a control device 30.

The control device 30 controls a packaging machine 34 serving as a processing device 32. This has an input belt conveyor 36, which is driven in the same conveying direction F as the conveying device 10 and at a speed $V_2$. An end section 38 located upstream of the input belt conveyor 36 is located underneath the conveying device 10 at the triggering device 20 and, as shown, runs parallel to the conveying device 10.

Following the end section 38 serving as a transfer section in the conveying direction F, the input belt conveyor 36 has a feed section 38' with a declivity. The end section 38 and the feed section 38' are driven by means of a drive motor 40 which, as indicated by the dash-dotted line 42, is controlled from the control device 30. In the exemplary embodiment shown, the speed $V_2$ of the input belt conveyor 36 corresponds approximately to the conveying speed $V_1$ of the conveying device 10.

Shown on the input belt conveyor 36 is an overlapping formation S, which is formed by the printed articles 18 transferred to the input belt conveyor 36 at the triggering device 20. In this overlapping formation S, the printed articles 18 rest on the respectively preceding printed article.

In the region of the feed section 38', there is a pair of pressure rolls 46 defining a press nip 44 of the thickness P and belonging to a pressure element 48. The spacing of the pair of pressure rolls 46, and thus the thickness P of the press nip 44, can be adjusted by means of an actuating motor 50 which, as indicated by the dash-dotted line 42', is actuated by the control device 30. Of course, the pair of pressure rolls 46 can also be driven in rotation at the circumferential speed $V_2$, in such a way that the press nip 44 also forms a conveying nip.

The end of the input belt conveyor 36 which is placed downstream is located in the interior of a machine housing 52. The end region of the input belt conveyor 36 on this side forms a stabilization gap 56 together with a small pressure belt arranged above the latter and serving as a stabilization element 54. The stabilization gap 56 imparts stability to the printed articles 18 leaving the input belt conveyor 36 at this end, so that they also leave the stabilization gap 56 at a high speed $V_2$ and, so to speak, can be fed in a "flying" manner to a stack forming device 58 of the packaging machine 34.

At right angles to the longitudinal direction of the input belt conveyor 36, the latter and the stabilization element 54 have a shape in the region of the stabilization gap 56 in the form of a gable roof or a V, which stiffens the printed articles 18 in such a way that their region coming out of the stabilization gap 56 can bend neither upward nor downward. In order to impart the appropriate form to the conveyor belt and the small conveyor belt of the input belt conveyor 36 in the end region on this side, a supporting plate 60 can be provided, on which the conveyor belt and the small conveyor belt run and are supported by the latter.

As indicated by the double arrow A and the dash-dotted line 42", the spacing between the input belt conveyor 36 and the stabilization element 54, and thus the thickness of the stabilization gap 56, can be adjusted automatically by the control device 30. For this purpose, use is made of a further actuating motor, not shown for improved clarity.

The stack forming device 58, arranged following the end of the input belt conveyor 36 seen in the conveying direction F, has two endless elements 62, for example belts or chains, which are arranged at a distance from each other in the horizontal direction and are guided around deflection wheels 64 arranged one above the other in the vertical direction and mounted with their axes horizontal. The endless elements 62 are driven by means of a further drive motor 66 which, as indicated by the dash-dotted line 42'", is likewise actuated by the control device 30.

Three stack tables 68, for example, which can be formed by profiles arranged in the manner of forks, are fixed to the two endless elements 62 with equal spacing in such a way that, in the region of a run extending vertically and facing the input belt conveyor 36, they project obliquely upward from the endless elements 62. In a position of the stack tables 68 shown in FIG. 1—only two are shown for improved clarity—there is an upper stack table 68 at the upper end of the aforementioned run, the free end of the stack table 68 being located in the vicinity of the end of the stabilization gap 56 and thus of the end of the input belt conveyor 36. A lower stack table 68 is located at the lower end of the aforementioned run, and a stack 70 of height H formed thereon from printed articles 18 fed in previously is indicated by dashed lines.

When the endless elements 62 are driven in the clockwise direction, the stack 70 is picked up by an output conveyor, for example constructed as a tape conveyor, and fed for further processing. A fork-like construction of the stack tables 68 and a tape conveyor construction of the output conveyor are suitable in particular because the forks of the stack tables 68 can move through between the mutually spaced narrow belts.

The pressure element 48, the stabilization element 54, together with the input belt conveyor 36 and the stack forming device 58, form processing elements 71 of the processing device 32 which are actuated by the control device 30 as a function of the measured signal 28 and act on the printed articles 18.

Figure 2:
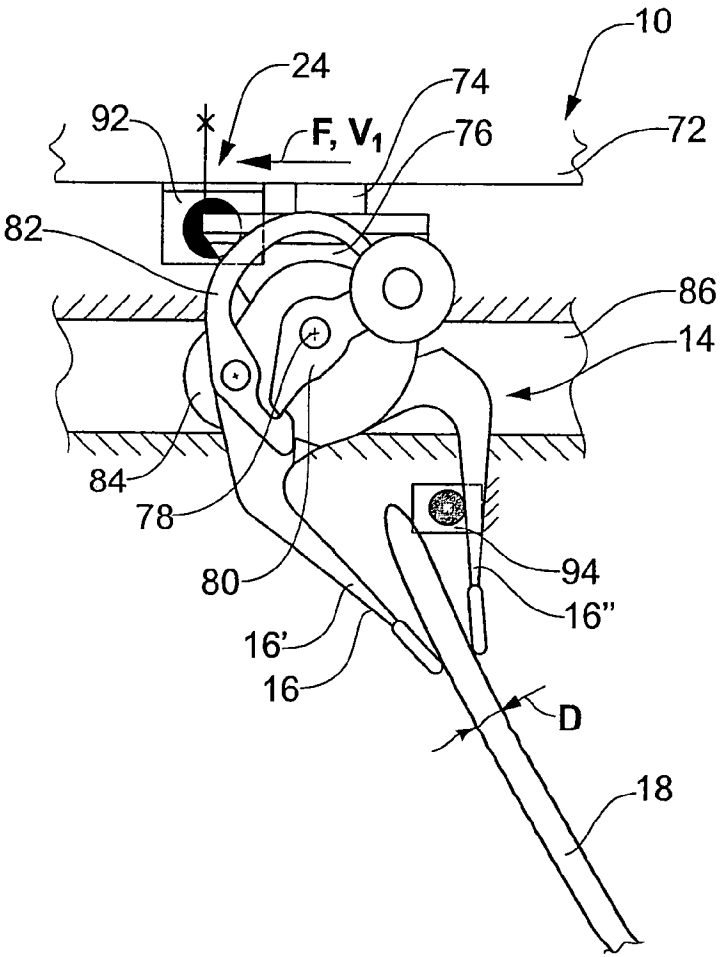
FIG. 2 shows, in an enlargement with respect to FIG. 1, a transport clamp holding a folded printed article and belonging to the conveying device as it passes two light barriers of a thickness measuring device.
Figure 3:
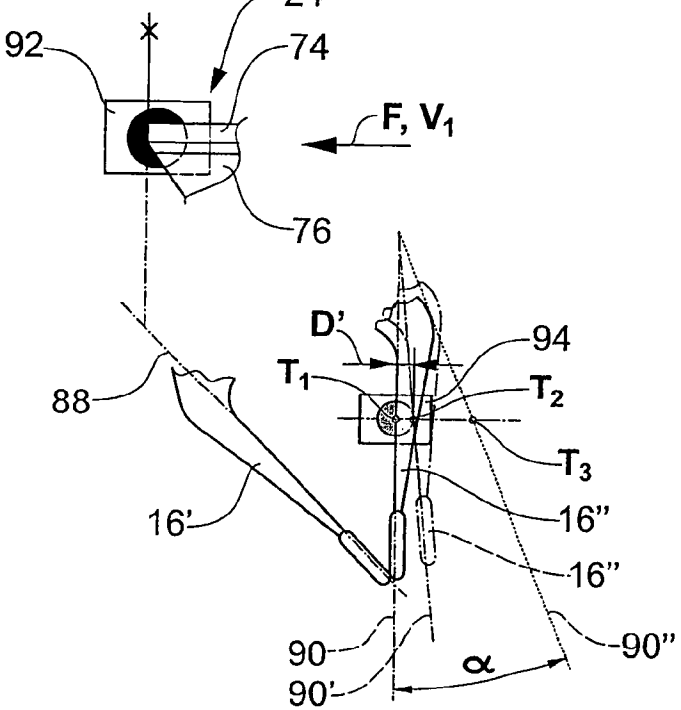
FIG. 3 shows, in the same illustration as FIG. 2, a part of a transport clamp, the position of the clamping tongues without a printed article being indicated by continuous lines and the position when firmly holding a printed article being indicated by dash-dotted lines.

The thickness measuring device 22 can be constructed, for example, in the manner disclosed in EP-A-0 897 887. For the present purpose of controlling a processing device 32, however, a simpler embodiment of the thickness measuring device 22 may also be suitable, as illustrated in FIGS. 2 and 3.

All the transport clamps 14 of the conveying device 10 are identical and, for example, constructed as disclosed in EP-A-0 600 183 and corresponding U.S. Pat. No. 5,395,151. In the following text, the construction and the functioning of the transport clamps 14 will be explained only in summary, and the disclosures of these patent documents are incorporated by reference.

The conveying element 12 driven in circulation in the conveying direction F at the speed $V_1$ and, for example, constructed as a chain which is guided in a channel 72 of C-shaped cross section. At the given spacing, a carrier 74 for each transport clamp 14 projects from the conveying element 12, which carrier reaches through the gap in the channel 72 and to which a base body 76 of the transport clamp 14 is fixed. On the base body 76, the two clamping tongues 16 are mounted such that they can rotate about an axis 78 running at right angles to the conveying direction F. In the closed position of the transport clamps 14, the two clamping tongues 16 are prestressed in the direction of each other under spring load. Relieving the spring prestress is prevented by a pawl lever 82 interacting with a clamping lever 80. In order to open the transport clamp 14, the triggering device 20 (FIG. 1) acts on the pawl lever 82 and rotates the latter in the clockwise direction.

The leading clamping tongue 16 seen in the conveying direction F is designated 16', the trailing clamping tongue is designated 16". On a shaft fixed to the leading clamping tongue 16', a control roller 84 is mounted such that it can rotate freely and, in the region of the thickness measuring device 22, is guided in a pivoting slotted guided 86 running parallel to the channel 72. As a result, the rotational position of the leading clamping tongue 16 is fixedly predefined. It runs in the downward direction and obliquely rearward in the conveying direction F. In FIG. 3, this position is illustrated by the dash-dotted line 88.

If there is no printed article 18 in the clamping jaw formed by the clamping tongues 16, the ends of the clamping tongues 16 rest on each other. The corresponding rest position of the trailing clamping tongues 16" is indicated by continuous lines in FIG. 3 and illustrated by the dash-dotted position line 90. However, if there is a printed article 18 in the jaw of the transport clamp 14, as illustrated in FIG. 2, the trailing clamp 16" assumes a rotational position indicated by dash-dotted lines in FIG. 3 and illustrated by the position line 90'. If a printed article 18 of great thickness is held by the transport clamp 14, the trailing clamping tongue 16" for example assumes a position which is indicated by the position line 90" and an angle $\alpha$ between this position line 90" and the position line 90.

The thickness measuring arrangement 24 has a fixed-location first light barrier 92, which in each case outputs a signal to the signal conditioning unit 26 when it is interrupted by the carrier 74 or by the base body of 76 of a transport clamp 14. The thickness measuring arrangement 24 has a second light barrier 94, which is arranged in a fixed location in the range of movement of the trailing clamping tongue 16". This second light barrier 94 outputs a signal to the signal conditioning unit 26 when it is interrupted by the trailing clamping tongue 16".

Seen in the conveying direction F, the first light barrier 92 and the second light barrier 94 are advantageously positioned in such a way that they are interrupted simultaneously by the base body 76 or carrier 94 or by the trailing clamping tongue 16 in the case in which no printed article 18 is held by the transport clamp 14, and thus the two clamping tongues 16' and 16" rest on each other in accordance with the position line 90 in FIG. 3. In this case, as indicated by the points T1, T2 and T3 in FIG. 3, the second light barrier 94 outputs a sensor signal to the signal conditioning unit 26 which is delayed with respect to the first light barrier 92 on the basis of the thickness of the printed article 18. With such an arrangement of the light barriers 92, 94, it can also be ensured in a straightforward manner that the interruption of the second light barrier 94 by the leading clamping tongue 16' does not lead to an error, since the sensor signal from the second light barrier 94 must in any case arrive at the signal conditioning unit 26 simultaneously or later than the sensor signal from the first light barrier 92.

On the basis of the sensor signals from the first light barrier 92—during continuous operation—the signal conditioning unit 26 determines the conveying speed $V_1$ and, from the time delay of the sensor signal from the second light barrier 94 (corresponding to the double arrow D') as compared with that from the first light barrier 92, determines the thickness D of the respective printed article 18. In this case, the transport clamps 14 themselves, if appropriate together with the carriers 74, serve as a measuring aid. A measured signal corresponding to this thickness and a further measured signal corresponding to the conveying speed $V_1$ are fed to the control device 30, as indicated by the line 28.

The printed articles 18 are held individually by one transport clamp 14 in each case. By using FIGS. 4-7, it will be explained what is to be understood as a printed article 18 in the present case.

Figure 4:
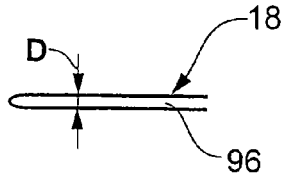
FIG. 4 shows a printed article which consists of a single printed product.

FIG. 4 shows in schematic form a printed article 18 which consists of a single printed product 96. In the present case, this is a folded printed product 96 comprising one or more sheets.

Figure 5:
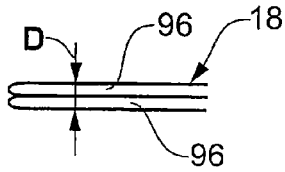
FIG. 5 shows a printed article which consists of two printed products arranged congruently one above the other.

As shown in FIG. 5, a printed article 18 can, however, consist of two printed products 96, as shown in FIG. 4, these two printed products 96 resting congruently on each other; these can be identical or different printed products 96.

Figure 6:
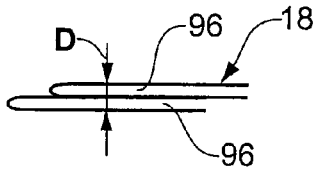
FIG. 6 shows a printed article which consists of two printed products arranged in an overlapping manner.

It is also possible for a printed article 18—as shown in FIG. 6—to be formed by two printed products 96 which rest on each other in an overlapping manner.

Figure 7:
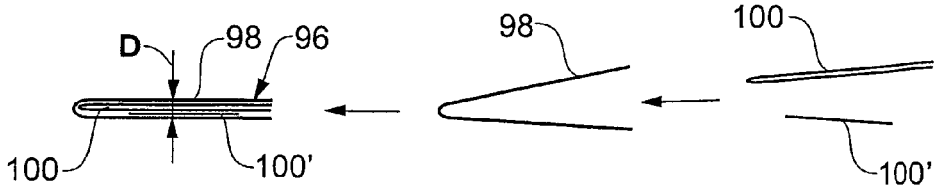
FIG. 7 shows a printed article which consists of a folded printed product and two further printed products inserted into the latter.

FIG. 7 shows a possible assembly of a printed product 96 which, if it is held solely by one transport clamp 94, forms a printed article 18. The printed product 96 according to FIG. 7 consists of a folded outer part 98 and two inner parts arranged beside each other and inserted therein, the inner part 100 likewise being folded and the inner part 100' being unfolded. The outer part 98 and inner part 100 can be, for example, parts of a newspaper and the inner part 100' can be an enclosure, such as card or the like.

Depending on the structure of the printed article 18, this can have a different thickness D.

Figure 8:
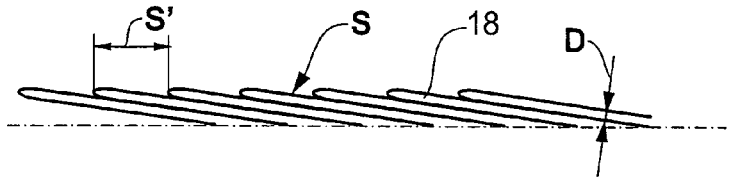
FIG. 8 shows a number of printed articles arranged in an overlapping formation, as can be supplied to the processing device.

FIG. 8 shows part of the overlapping formation S as is formed on the input belt conveyor 36 by printed articles 18 fed in by means of the conveying device 10. The printed articles 18 of thickness D are arranged at a mutual spacing as specified by the double arrow S'.

Figure 9:
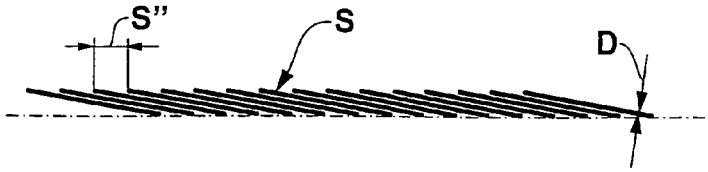
FIG. 9 shows a number of printed articles that are thinner as compared with FIG. 8 in an overlapping formation, as can be supplied to the processing device.

FIG. 9 likewise shows part of an overlapping formation S, but now the printed articles 18 having a smaller thickness D as compared with FIG. 8. However, since, as compared with the formation of the overlapping formation according to FIG. 8, when forming the overlapping formation according to FIG. 9, the conveying speed $V_2$ is chosen to be lower in relation to the conveying speed $V_1$, the mutual spacing S" of the printed articles 18 is smaller as compared with the overlapping formation according to FIG. 8. By choosing the spacing S', S" of the printed articles 18 in the overlapping formation S—by activating the drive motor 40 appropriately—the thickness of the overlapping formation S can thus also be adjusted. Since the measured thickness D of the printed articles 18, together with the spacing S', S" and the length of the printed articles 18, determine the thickness of the overlapping formation S in accordance with which the pressure roller pressing element 48 and the stabilization element 54 are to be set, the input belt conveyor 36 also forms a processing element 71.

The apparatus illustrated in the drawing operates as follows. The transport clamps 14 of the conveying device 10 are each populated with a printed article 18. The printed articles 18 are moved past the thickness measuring arrangement 24 by means of the conveying device 10. On the basis of the sensor signals from the thickness measuring arrangement 24, the signal conditioning unit 26 determines the measured signal 28, which corresponds to the thickness of each of the printed articles 18 and is fed to the control device 30. From this measured signal, the control device 30 also determines the conveying speed $V_1$ of the conveying device 10. Given knowledge of the mutual spacing of the transport clamps 14, the control device 30 can thus also determine the number of printed articles 18 accumulating per unit time.

On the basis of the measured signal 28 and the data determined from the latter, the control device 30 prescribes the conveying speed $V_2$ for the input belt conveyor 36 and actuates the drive motor 40 accordingly.

The triggering device 20 opens that number of transport clamps 14 being moved past it in accordance with the number of printed articles 18 which are to be laid on one another to form a stack 70. Because of the coordination of the conveying speeds $V_{1\ and\ V2}$, as the printed articles 18 are deposited on the input conveyor belt 36 at the triggering device 20, the overlapping formation S is formed, in which each printed article 18 rests on the preceding printed article at the desired spacing S', S".

Furthermore, the control device 30 uses the measured signal 28 to determine the necessary width of the press nip P and actuates the actuating motor 50 accordingly. In the same way, the control device 30 determines the spacing A between the input belt conveyor 36 and the stabilization element 54.

Moreover, the control device uses the measured signal 28 as the basis for determining the speed at which the corresponding stack table 68 is to be lowered, and actuates the further drive motor 66 accordingly. The start of lowering the relevant stack table 68 from the waiting position indicated by the upper stack table 68 in FIG. 1 can be carried out, for example, by there being a sensor, for example a light barrier, in the region of the input belt conveyor 36 or at the downstream end of the latter, which outputs a signal to the control device 30 when the first printed article 18 of the overlapping formation S arrives. However, it is also possible for the control device 30 to use the measured signal 28 as a basis for determining when the respective first printed article 18 from an overlapping formation S is fed to the stack table 68, and thus has to begin to lower the relevant stack table 68.

Once a complete stack 70 has been formed, the relevant stack table 68 is lowered further until the next stack table 68 is located in the waiting position. The packaging machine 34 is then ready to pick up a further number of printed articles 18 fed in and to form a stack 70 from them.

The thickness measuring device 22 is designed for a high measuring speed of, for example, 80000 measurements per hour. In order to be able to process the corresponding number of accumulating printed articles without interruption, to stack and package them in the present case, two or more packaging machines 34, which are loaded alternately with printed articles 18 by means of the conveying device 10, are arranged one behind another.

As an exemplary embodiment of a processing device 32, a packaging machine 34 has been explained. However, it is also possible for the apparatus according to the invention to have, instead of a packaging machine, a different type of processing device 32, of which processing elements have to be adjusted or driven on the basis of the thickness of the printed articles 18 to be processed. An example which may be mentioned is a device for trimming the printed articles, as disclosed in EP-A-602 594.

The apparatus according to the invention and the method according to the invention permit, firstly, automatic readjustment of the processing device 32 during operation and also, secondly, automatic setting of the processing device 32 in the event of the processing being changed from one type of printed articles 18 to another type of printed articles.

In a preferred way, the thickness of each of the printed articles 18 to be processed by the processing device 32 is measured. However, it is also possible to perform the thickness measurement only when starting to process a specific type of printed products 18 and to actuate the processing device 32 accordingly. In this case, it is also conceivable to remeasure the thickness on some printed articles 18 from time to time and to readjust the processing device 32 accordingly.

The length of the printed articles 18 and the overlap spacings S', S" can also be input to the control device 30 as fixed parameters. It is also conceivable to actuate only a single processing element 71 of the processing device 32 on the basis of thickness.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A method for processing printed articles, comprising the steps of transporting the articles in succession along a path of travel, measuring the thickness of each of the printed articles at a measuring location positioned along the path of travel, and wherein the measuring step includes generating a measured signal which represents the measured thickness of each printed article, discharging the printed articles at the downstream end of the path of travel to a processing device where the printed articles are acted on by at least one processing element, and controlling the at least one processing element as a function of the measured signal, wherein the transporting step includes individually holding the printed articles between clamping tongues of transport clamps which are moved along the path of travel, wherein the clamping tongues are configured to positionally indicate the thickness of the printed product being transported thereby, with the indicated thickness being converted to said measured signal, and wherein the step of generating a measured signal includes measuring the time difference between the passage past at least one barrier of a reference part of each transport clamp which is fixedly predefined and the passage of a clamping tongue which assumes a different position based on the thickness of the printed article being held.

2. The method of claim 1, wherein the controlling step includes adjusting the at least one processing element.

3. The method of claim 2, wherein the passage of the reference part is detected by a first light barrier and the passage of the clamping tongue is detected by a second light barrier.

4. The method of claim 1, wherein the passage of the reference part is detected by a first light barrier and the passage of the clamping tongue is detected by a second light barrier.

5. An apparatus for processing printed articles, comprising a conveying device for transporting the articles in succession along a path of travel, said conveying device including a plurality of transport clamps positioned in spaced relation along a conveying element for holding respective ones of the printed articles, a measuring device fixed along the path of travel and a measuring aid associated with each transport clamp for measuring the thickness of the printed articles being transported past the measuring device and for generating a measured signal as a function of the measured thickness, a processing device to which the conveying device discharges the printed articles to be processed, with the processing device arranged downstream of the measuring device and having at least one processing element which acts on the printed articles, and a control device which acts as a function of the measured signal to control the at least one processing element, and wherein the conveying device has a large number of identically constructed transport clamps each having two clamping tongues for individually holding and transporting the printed articles, and the measuring device comprises a barrier arrangement which acts to determine the time difference between (1) the passage of a reference part of each transport clamp or a part connected firmly thereto and (2) the passage of a clamping tongue which assumes a different position on the basis of the thickness of the printed article, past the barrier arrangement.

6. The apparatus of claim 5, wherein the at least one processing element is connected to a drive element, and wherein the drive element is controlled by the control device.

7. The apparatus of claim 5, wherein the barrier arrangement comprises a first light barrier which is positioned to be interrupted by the passage of a reference part of each transport clamp or a part connected firmly thereto, and a second light barrier which is positioned to be interrupted by the passage of the clamping tongue which assumes a different position on the basis of the thickness of the printed article.

8. The apparatus of claim 5, wherein the processing device comprises a packaging machine having, as processing elements, an input belt conveyor, a pressure roller pressing element, a stabilization element interacting with the input belt conveyor, and a stack support that can be lowered, and, as a function of the measured signal, the control device acts to control or adjust the spacing of pressure rollers of the pressure roller pressing element, the spacing between the input belt conveyor and the stabilization element, and also the lowering of the stack support.

9. The apparatus of claim 8, wherein the control device controls the drive of the input belt conveyor.

* * * * *